US009730564B2

(12) United States Patent
Butts et al.

(10) Patent No.: US 9,730,564 B2
(45) Date of Patent: Aug. 15, 2017

(54) SYSTEM WITH PLUNGER AND CADDY

(71) Applicant: Butler Home Products, LLC, Marlborough, MA (US)

(72) Inventors: Mark Butts, Atlanta, GA (US); Jeff Tadin, Canton, GA (US)

(73) Assignee: BUTLER HOME PRODUCTS, LLC, Hudson, MA (US)

( * ) Notice: Subject to any disclaimer, the term of this patent is extended or adjusted under 35 U.S.C. 154(b) by 200 days.

(21) Appl. No.: 14/789,321

(22) Filed: Jul. 1, 2015

(65) Prior Publication Data

US 2016/0000281 A1 Jan. 7, 2016

Related U.S. Application Data

(60) Provisional application No. 62/020,035, filed on Jul. 2, 2014.

(51) Int. Cl.

| | |
|---|---|
| ***B65D 71/00*** | (2006.01) |
| ***A47K 17/00*** | (2006.01) |
| ***A47G 29/08*** | (2006.01) |
| *A47K 11/10* | (2006.01) |
| *E03C 1/308* | (2006.01) |

(52) U.S. Cl.

CPC ..... *A47K 17/00* (2013.01); *A47G 29/08* (2013.01); *A47K 11/10* (2013.01); *E03C 1/308* (2013.01)

(58) Field of Classification Search

CPC ..... A47K 17/00; A47K 11/10; A47G 29/08
USPC ..... 206/15.2, 15.3, 349, 581
See application file for complete search history.

(56) References Cited

U.S. PATENT DOCUMENTS

| | | | | |
|---|---|---|---|---|
| 4,033,650 | A * | 7/1977 | Alissandratos | A46B 5/00 312/206 |
| D525,467 | S | 7/2006 | Michelson et al. | |
| 7,669,715 | B2 * | 3/2010 | Wang | B65F 1/08 206/349 |
| 2005/0252804 | A1 * | 11/2005 | Leaphart | A47K 17/00 206/349 |
| 2009/0000967 | A1 * | 1/2009 | Shafik | A47K 17/00 206/349 |
| 2009/0211926 | A1 * | 8/2009 | Wang | A46B 17/02 206/15.3 |
| 2010/0084292 | A1 * | 4/2010 | Wildauer | E03C 1/308 206/349 |
| 2013/0180874 | A1 * | 7/2013 | Yang | A47K 11/10 206/349 |
| 2016/0045088 | A1 * | 2/2016 | Coleman | A47K 17/00 206/349 |

* cited by examiner

*Primary Examiner* — Luan K Bui
(74) *Attorney, Agent, or Firm* — McCarter & English, LLP

(57) ABSTRACT

A system includes a plunger and a caddy. The plunger includes a plunger cup, a plunger handle extending from a top of the plunger cup, and a plunger engagement member disposed relative to the top of the plunger cup. The caddy defines a first caddy cavity configured to receive at least a portion of the plunger cup when the system is in a carry mode. The caddy also defines a caddy stopper disposed relative to a top portion of the first caddy cavity. The caddy is configured such that, in the carry mode, the bottom of the plunger cup contacts a caddy base surface of the caddy that at least partially defines the first caddy cavity, and the plunger engagement member engages the caddy stopper, to thereby press-fittingly connect the plunger and the caddy.

8 Claims, 8 Drawing Sheets

SYSTEM WITH PLUNGER AND CADDY

This application claims priority under 35 U.S.C. §119 to U.S. Provisional Application No. 62/020,035 filed on Jul. 2, 2014, the entire contents of which are hereby incorporated by reference.

BACKGROUND

The present invention relates to a system with a plunger and a caddy, and more particularly relates to a system that includes a plunger that can be press-fittingly connected to a caddy.

It is known to provide a system that includes a plunger and a caddy for storing the plunger. In some instances, the plunger can be connected to the caddy to permit the system (i.e., the plunger and the caddy) to be carried by the handle of the plunger. In some instances, connection of the plunger to the caddy requires the user to touch the caddy, which may be undesirable given the possible presence of germs or other contaminants on the caddy. In some instances, connection of the plunger to the caddy requires that the plunger be twisted or positioned relative to the caddy in a manner that may be difficult for a user to perform. In some instances, connection of the plunger to the caddy may involve use of components that result in added expense for the manufacturer, and thus added expense to the consumer. Aspects of the present invention are directed to these and other problems.

SUMMARY OF THE INVENTION

According to one aspect of the present invention, a system includes a plunger and a caddy. The plunger includes a plunger cup, a plunger handle extending from a top of the plunger cup, and a plunger engagement member disposed relative to the top of the plunger cup. In one embodiment, the caddy is comprised of a base and a cover that together define a first caddy cavity configured to receive at least a portion of the plunger cup when the system is in a carry mode. The caddy also defines a caddy stopper disposed relative to a top portion of the first caddy cavity. The caddy is configured such that, in the carry mode, the bottom of the plunger cup contacts a caddy base surface of the caddy that at least partially defines the first caddy cavity, and the plunger engagement member engages the caddy stopper, to thereby press-fittingly connect the plunger and the caddy. The caddy cover may optionally include a second cavity for holding a cleaning implement such as a scrub brush.

This and other aspects of the present invention will become apparent in light of the drawings and detailed description provided below.

DETAILED DESCRIPTION OF THE INVENTION

Figure 1:
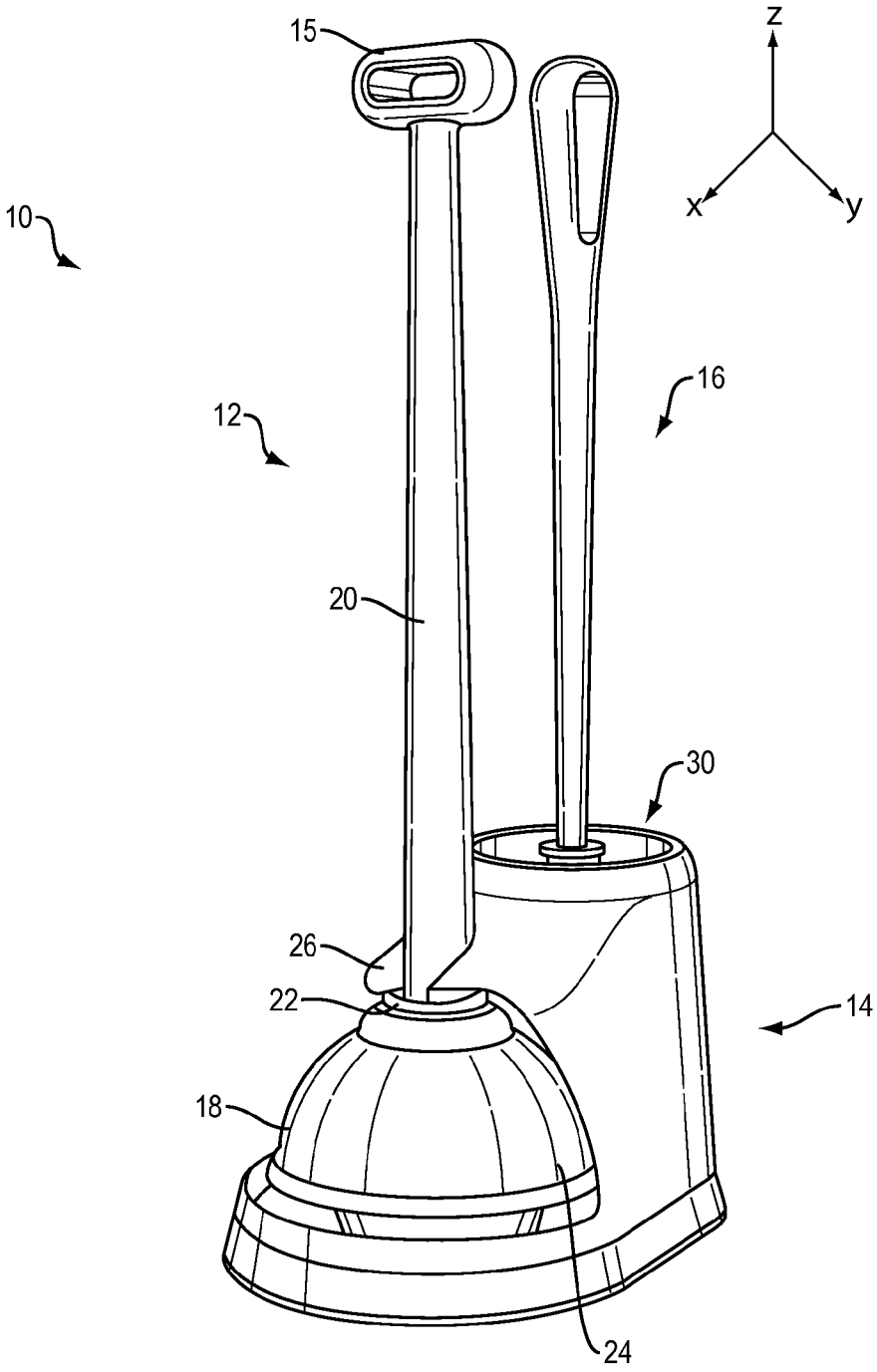
FIG. 1 illustrates a perspective view of an embodiment of the present system.
Figure 2:
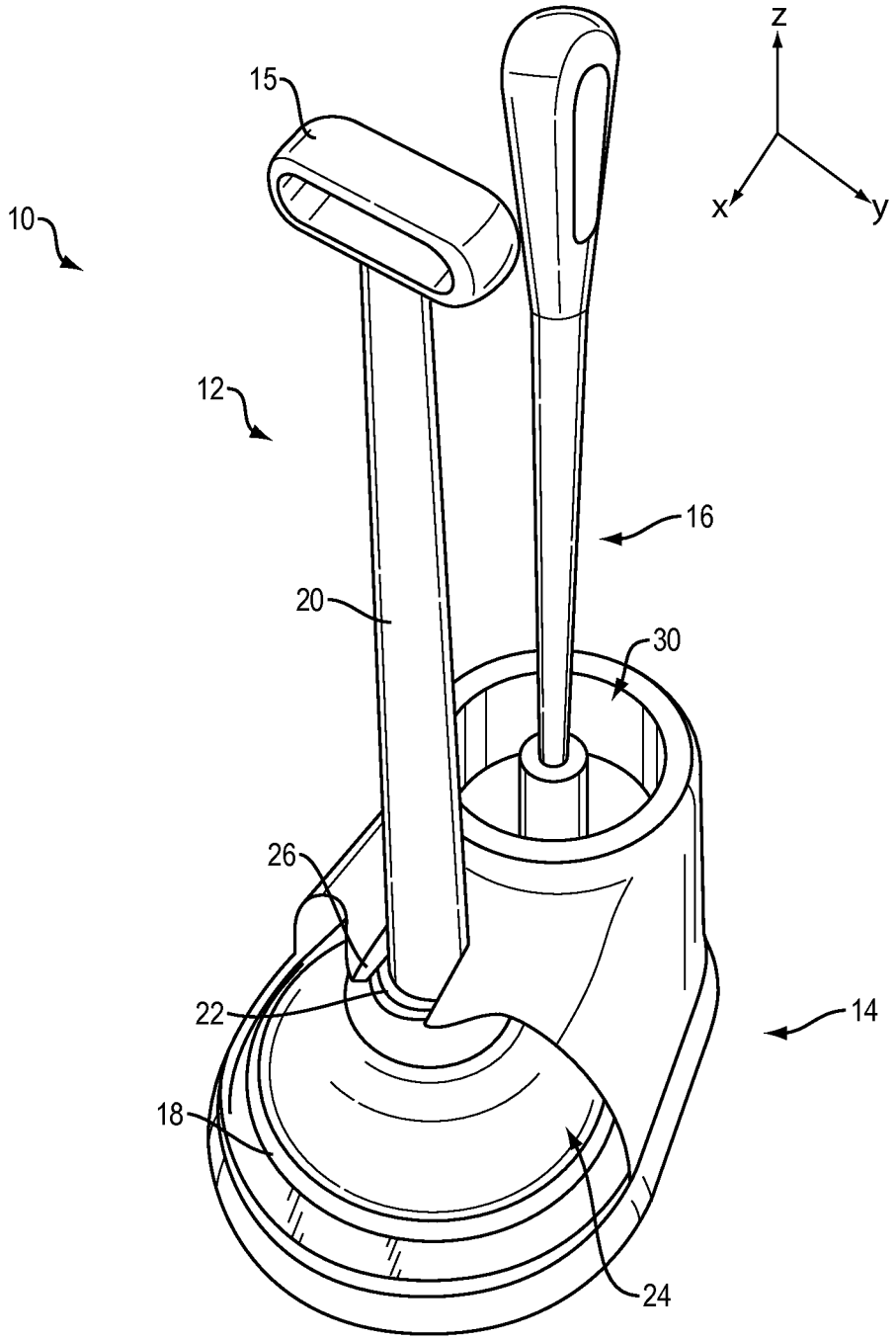
FIG. 2 illustrates a second perspective view of the system of FIG. 1.
Figure 3:
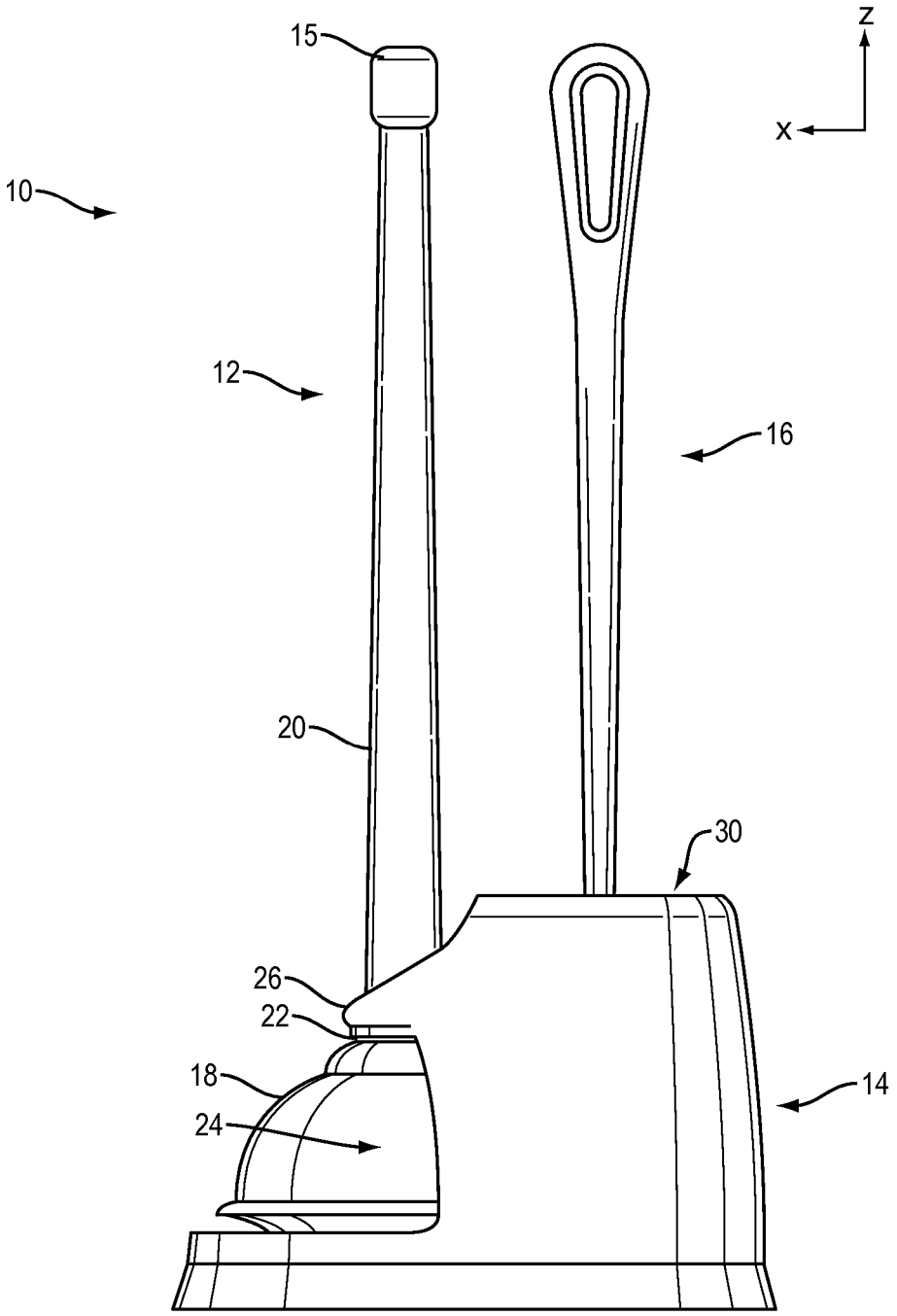
FIG. 3 illustrates a side elevation view of the system of FIG. 1.

Referring to FIGS. 1-8, the present disclosure describes a system 10 (see FIGS. 1-3 and 6-8) that includes a plunger 12 (see FIGS. 1-4 and 6-8) and a caddy 14 (see FIGS. 1-3 and 5-8). In some embodiments, the system 10 additionally includes a brush 16 (see FIGS. 1-3 and 6-8).

The present disclosure describes the present invention with reference to the exemplary embodiment illustrated in the drawings; however, the present invention is not limited to the exemplary embodiment illustrated in the drawings. The present disclosure may describe one or more features as having a length extending relative to an x-axis, a width extending relative to a y-axis, and/or a height extending relative to a z-axis. The drawings illustrate the respective axes.

Referring to FIGS. 1-3 and 6-8, the plunger 12 includes a plunger cup 18 and a plunger handle 20 having a proximate end for gripping and a distal end attached to the plunger cup 18. A plunger engagement member 22 is attached to the distal end of the plunger handle 20. The plunger handle 20 may have a grip 15 for holding the plunger. The plunger engagement member 22 may be molded as an integral part of the plunger handle 20 where the handle is made of a moldable material such as, for example, a plastic. Alternatively, the plunger engagement member 22 may be a separate piece that is fixedly attached to the distal end of the plunger handle 20 or to the top of the plunger cup 18.

The caddy 14 comprises a caddy base 32 (see FIG. 5) and a caddy cover 34 (see FIG. 5) which together define a first caddy cavity 24 configured to receive at least a portion of the plunger cup 18 when the system is in a carry mode (see FIGS. 1-3 and 6). The caddy cover 34 defines a caddy stopper 26 disposed relative to a top portion of the first caddy cavity 24. The caddy 14 is configured such that, in the carry mode, the bottom of the plunger cup 18 contacts a base surface 28 (see FIG. 5) of the caddy base 32 that at least partially defines the first caddy cavity 24, and the plunger engagement member 22 engages the caddy stopper 26, to thereby press-fittingly connect the plunger 12 and the caddy 14 (see FIG. 6). In the carry mode, the press fit connection between the plunger 12 and the caddy 14 enables the system 10 to be carried (e.g., transported as unitary structure) by holding only the plunger handle 20. In some embodiments, including the illustrated embodiment, the caddy cover 34 additionally defines a second caddy cavity 30 configured to receive at least a portion of a brush 16 (e.g., a toilet bowl brush) or another home cleaning tool.

Figure 4:
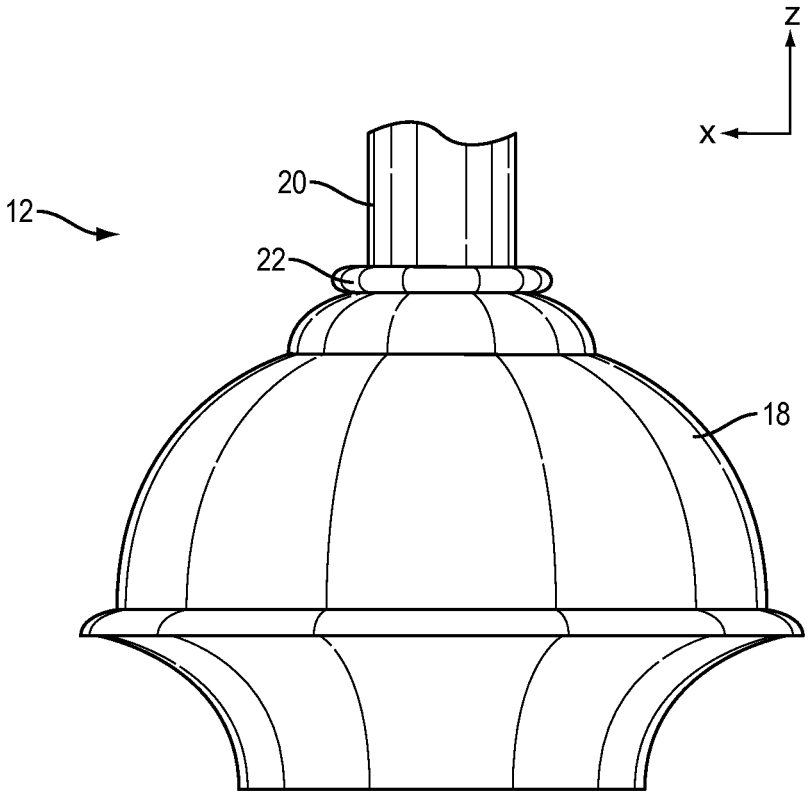
FIG. 4 illustrates a side view of the plunger cup and a portion of the handle attached to the plunger cup.

Referring to FIG. 4, the plunger 12 can be configured similar to known plungers (e.g., known toilet bowl plungers, known sink plungers, etc.). As such, the plunger cup 18 can be made of rubber or another flexible material, and the plunger handle 20 can be made of wood, metal, and/or another rigid material. The plunger cup 18 can be in an ambient state (see FIG. 4), or it can be compressed toward a compression state (see FIG. 8). The plunger 12 differs from known plungers in that it additionally includes the plunger engagement member 22. In the illustrated embodiment, the plunger engagement member 22 is an annular flange disposed proximate the top of the plunger cup 18. In other embodiments, the plunger engagement member 22 can have another structure suitable for performing the functionality described herein.

Figure 5:
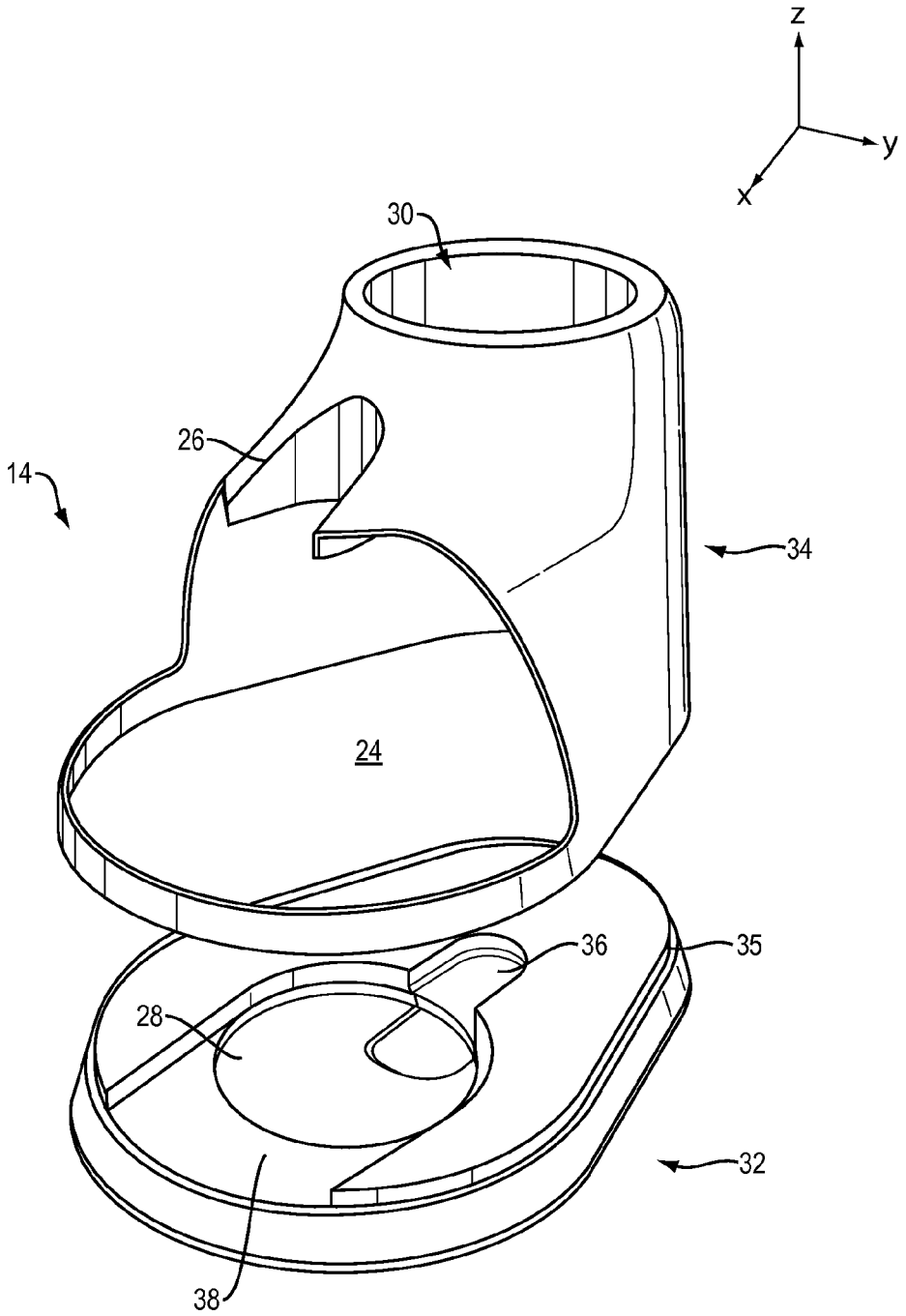
FIG. 5 illustrates an exploded perspective view of the caddy included in the system of FIG. 1.
Figure 6:
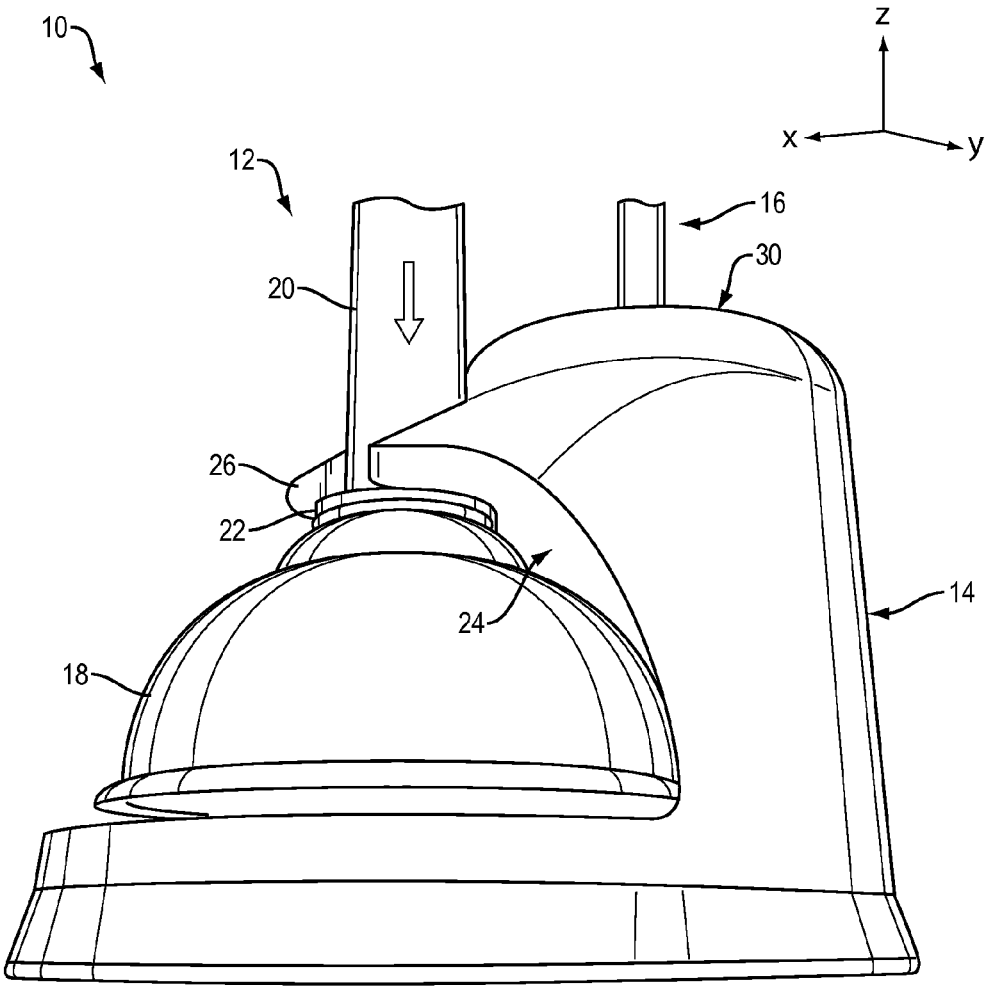
FIG. 6 illustrates a partial perspective view of the system of FIG. 1, showing the plunger stored within the first caddy cavity.
Figure 7:
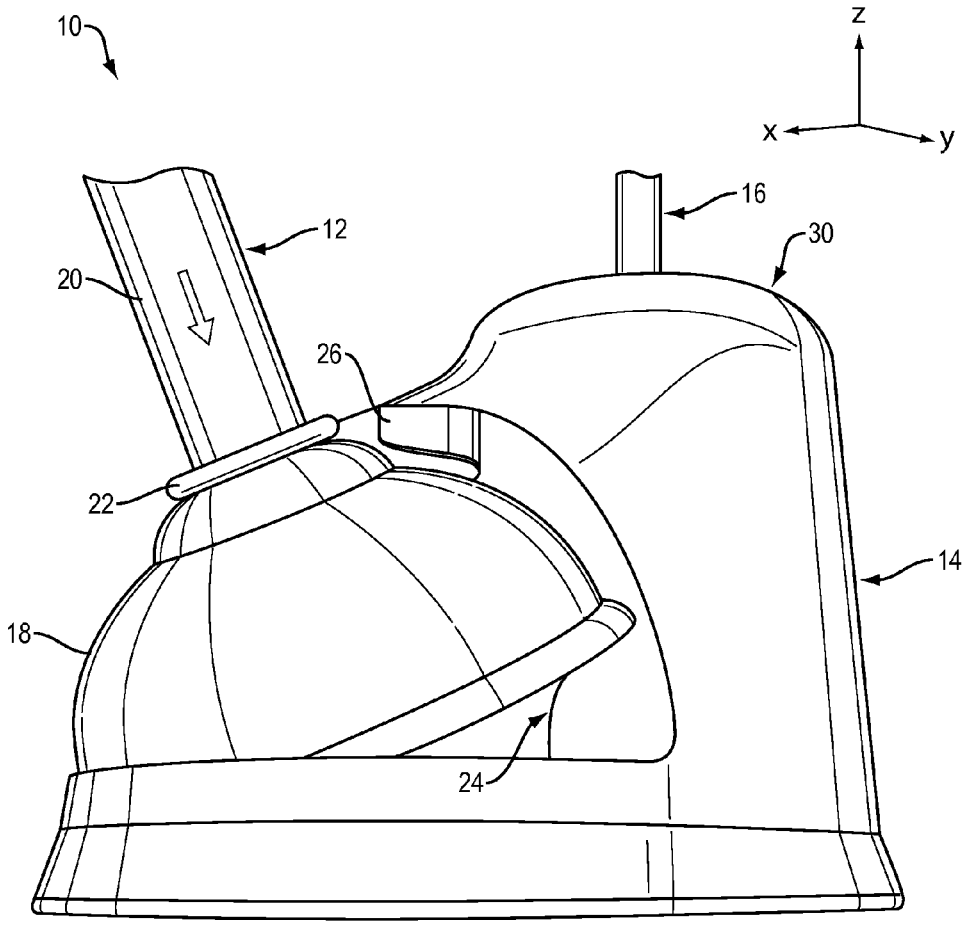
FIG. 7 illustrates a partial perspective view of the system of FIG. 1, showing the plunger received within the first caddy cavity.
Figure 8:
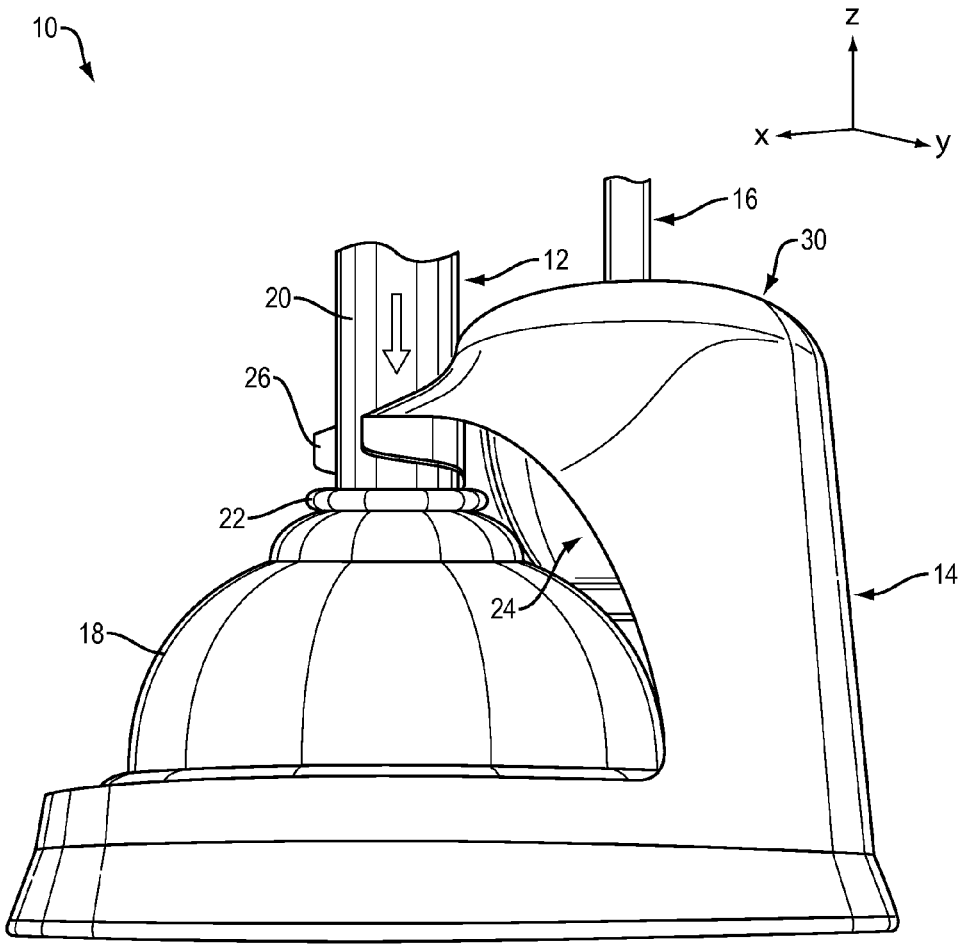
FIG. 8 illustrates a partial perspective view of the system of FIG. 1, showing the plunger being depressed to disengage the plunger engagement member from the caddy stopper to permit removal of the plunger from the first caddy cavity.

Referring to FIG. 5, the caddy 14 can be configured in various different ways. In the illustrated embodiment, the caddy 14 includes a caddy base 32 and a caddy cover 34, which collectively define the first caddy cavity 24 therebetween. The caddy base 32 and the caddy cover 34 are separable, which facilitates cleaning of the caddy 14. In other embodiments, the caddy 14 can be a unitary structure defining a first caddy cavity 24 for the plunger 12 and, optionally, a second caddy cavity 30 for a cleaning brush 16. The caddy base 32 and caddy cover 34 may be removably attached to each other by a press fit, tabs, or by any other means known to those skilled in the art.

The caddy base 32 forms the base surface 28 of the caddy 14, which contacts the bottom of the plunger cup 18 when the plunger 12 is press-fittingly connected to the caddy 14. The caddy base 32 forms a rib wall 35 that extends around the base surface 28 to prevent fluid from flowing off of the base surface. The base surface 28 includes a vent gutter 36 and an insert ramp 38, both of which are described in further detail below.

The caddy cover 34 defines the second caddy cavity 30, which is configured receive the cleaning brush 16. The caddy cover 34 also defines the caddy stopper 26, which engages the plunger engagement member 22 when the plunger 12 is press-fittingly connected to the caddy 14. The configuration (e.g., size, shape, relative position, etc.) of the caddy stopper 26 can vary depending on the configuration (e.g., size, shape, relative position, etc.) of the plunger engagement member 22. In the illustrated embodiment, the caddy stopper 26 includes two (2) flanges positioned to engage the plunger engagement member 22 at opposing sides of the plunger handle 20.

Referring to FIGS. 1-4 and 6-8, the relative configurations of the plunger 12 and the caddy 14 are selected such that: (1) when the plunger 12 is in its ambient state (see FIG. 4), a heightwise-extending distance between the bottom of the plunger cup 18 and the top of the plunger engagement member 22 is at least equal to (and preferably slightly greater than) a heightwise-extending distance between the base surface 28 of the caddy 14 and a bottom surface of the caddy stopper 26; and (2) when the plunger 12 is its compression state (see FIG. 8), a heightwise-extending distance between the bottom of the plunger cup 18 and the top of the plunger engagement member 22 is less than a heightwise-extending distance between the base surface 28 of the caddy 14 and a bottom surface of the caddy stopper 26. As a result of these relative configurations of the plunger 12 and the caddy 14, when the system 10 is in its carry mode (see FIGS. 1-3) and the plunger 12 is in its ambient state, the plunger 12 will be press-fittingly connected to the caddy 14. Alternatively, when the plunger 12 is in its compressed state, the plunger 12 will not be press-fittingly connected to the caddy 14.

During use of the system 10, when the plunger 12 is separate from the caddy 14, it can be press-fittingly connected to the caddy 14 by first positioning the bottom of the plunger cup 18 on the base surface 28 of the caddy 14 (see FIG. 7), and then compressing the plunger cup 18 (e.g., by pushing down on the plunger handle 20) until the top of the plunger engagement member 22 is able to engage the bottom surface of the caddy stopper 26. The insert ramp 38 on the base surface 28 of the caddy 14 aids in guiding the plunger 12 into the correct position relative to the caddy 14, and the vent gutter 36 on the base surface 28 allows air to escape from between the plunger cup 18 and the base surface 28 during compression of the plunger cup 18. Next, the compression of the plunger cup 18 can be reduced, which will cause the plunger engagement member 22 to engage the bottom surface of the caddy stopper 26 and thereby press-fittingly connect the plunger 12 and the caddy 14.

While several embodiments have been disclosed, it will be apparent to those of ordinary skill in the art that the present invention include many more embodiments and implementations. Accordingly, the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A plunger and caddy system, comprising:

a plunger having a plunger cup, a plunger handle extending from a proximal gripping end to a distal end connected to a top of the plunger cup, and a plunger engagement member disposed relative to the top of the plunger cup; and a caddy defining a first caddy cavity configured to receive at least a portion of the plunger cup when the system is in a carry mode, and defining a caddy stopper disposed relative to a top portion of the first caddy cavity;

wherein the caddy is configured such that, in the carry mode of the system, the bottom of the plunger cup contacts a caddy base surface of the caddy that at least partially defines the first caddy cavity, and the plunger engagement member engages the caddy stopper, to thereby press-fittingly connect the plunger and the caddy.

2. The plunger and caddy system of claim 1, wherein the caddy further defines a second caddy cavity configured to receive a cleaning brush.

3. The plunger and caddy system of claim 1, wherein the plunger handle further comprises a grip at the proximal end of the handle.

4. The plunger and caddy system of claim 1, wherein the handle is a molded plastic and the engagement member is molded as an integral part of the handle.

5. The plunger and caddy system of claim 1, wherein the caddy comprises a caddy cover removably attached to a caddy base.

6. The plunger and caddy system of claim 5, wherein the caddy cover is removably attached to the caddy base by a press fit attachment.

7. The plunger and caddy system of claim 6, wherein the caddy base defines a rib wall.

8. The plunger and caddy system of claim 7, wherein the caddy base further defines a vent gutter and an insert ramp.

* * * * *